United States Patent [19]

Takagi

[11] 4,244,175

[45] Jan. 13, 1981

[54] METHOD AND APPARATUS FOR MANUFACTURING A THREE-DIMENSIONED CRIMP FILAMENT

[76] Inventor: Sadaaki Takagi, 39, Mikage-cho, Okazaki-shi, Aichi-ken, Japan

[21] Appl. No.: 963,039

[22] Filed: Nov. 22, 1978

Related U.S. Application Data

[63] Continuation-in-part of Ser. No. 799,180, May 23, 1977, Pat. No. 4,154,051.

[51] Int. Cl.[3] ..... D02G 1/02; D02G 1/04

[52] U.S. Cl. ..... 57/282; 57/2; 57/284; 57/332

[58] Field of Search ..... 57/222, 284, 2, 332

[56] References Cited

U.S. PATENT DOCUMENTS

| | | | |
|---|---|---|---|
| 2,959,906 | 11/1960 | Richter | 57/282 |
| 3,017,684 | 1/1962 | Pittman | 57/2 X |
| 3,034,277 | 5/1962 | Richter | 57/346 |
| 3,328,950 | 7/1967 | Scragg et al. | 57/335 |
| 3,379,003 | 4/1968 | Kanbar | 57/2 |
| 4,154,051 | 5/1979 | Takagi | 57/284 |

*Primary Examiner*—John Petrakes
*Attorney, Agent, or Firm*—Gordon W. Hueschen

[57] ABSTRACT

A three-dimensioned crimp filament is prepared by twisting a bundle of large denier filaments into a single twist while said filaments are stretched between a freely-rotatable first roller with a peripheral groove having 10–500 mm of diameter at a grooved portion and at least one other freely-rotatable second roller in a total denier of 50,000–3,000,000 denier by means of twisting action in a subsequent double twist step, double twisting said single-twisted filaments into a double twist up to said first roller and heating the filaments thus twisted into a double twist while passing them through a tubular guide means, cooling said double-twisted filaments to effect a heat-set while maintaining the twisting action; untwisting said double-twisted filaments thus heat-set to form three-dimensioned crimp filaments, and cutting said untwisted three-dimensioned crimp filaments into stable lengths. The diameter of the first roller at the grooved portion is correlated with the diameter of the double-twisted filaments formed to prevent the spread of the double twist back beyond the first roller, and the width of the peripheral groove and the diameter of the tubular guide means are sufficient freely to receive the double-twisted filament but insufficient to allow it to curl into a greater multiple twist.

12 Claims, 9 Drawing Figures

F
T
VI

F
Fd
Fs
2
2a
2b
3
3a
3b
3c
3d
R
T
4
5
6
7
8
9
10
11
12
13
14
15
16
17
18
19
20
21
22
23
23a
24
25
26
27
28
29
30
31
32
33
34
35
36
37
40
41
42
43
45
47
48
50
51
52

METHOD AND APPARATUS FOR MANUFACTURING A THREE-DIMENSIONED CRIMP FILAMENT

This application is in part a continuation of my copending U.S. application Ser. No. 799,180, filed May 23, 1977, now U.S. Pat. No. 4,154,051, issued May 15, 1979.

FIELD OF INVENTION AND PRIOR ART

This invention relates to a method and an apparatus for manufacturing three-dimensioned crimp filament and, more particularly, to a method and an apparatus for manufacturing three-dimensioned crimp filament of a synthetic fiber used as raw material for locked cushioning material.

Hitherto, filaments have usually been in the two-dimensioned form, and no substantial increase of the resiliency or improvement of the cushioning property has been obtained even if intersections of filaments are locked with an adhesive. In addition, if it is intended to form three-dimensioned crimp, it is likely that the crimp is chiefly formed only about a portion as a core so that desired three-dimensioned crimp effect cannot be obtained. Further, with the conventional crimp forming apparatus where temporary curing is made, the total denier is limited to 2,000 denier at the most in view of the mechanism, so that only small crimps can be obtained.

In order to improve the above various drawbacks in the conventional apparatus there has been proposed an apparatus for continuously manufacturing thick synthetic fiber crimped staples of several hundred denier as a single yarn for cushioning, which is provided with a heating means for effecting wet heating immediately before processing and a temporary twisting heating means for effecting two continuous single twists on rope consisting of an ordinary primary twist and a secondary double twist, and in which thermoplastic filaments are given double helical crimps which are thermally set by strong heating means provided between the afore-mentioned means and then subjected to releasing of the temporary twists and then cutting by a cutting means (Japanese Utility Model Publication No. 40402/74). This apparatus, however, has a drawback in that it is difficult to prevent spread of the double twist formed in the secondary double twist step back into the primary single twist step or zone.

Such drawbacks in the prior art, are avoided in an apparatus comprising a drive means for pulling filaments, a group of guide rollers positioning in a reverse U-shaped, said roller group being provided ahead of said drive means and adapted to be rotated so as to give forward and rearward portions of a plurality of filaments which stretched with a single twist formed thereon and being transferred by said drive means, mutually opposite twisting actions, a pair of rotative rollers each provided with a groove, said roller pair being provided immediately after the roller at the forward end in said roller group and provided with a non-slip means for pulling the single twisted forward portion said filaments at a transfer speed such that the filaments of said forward portion formed into a double twist and are cooled sufficiently to effect a thermal set, a heating means provided ahead of said roller group and serving to heat the filaments formed with a double twist, a single twist transfer roller group provided ahead of said heating means and consisting of a plurality of rollers for giving the filaments and given a predetermined rotational tension for guiding filaments formed with a single twist, and a means for stopping spread of double twist, said stopping means being provided on the last roller in said roller group. However, when a pulling roller is used a means for stopping spread of double twist, high compression force presses the formed double twist of the filament, so there are some drawbacks that not only untwisting and opening the filament becomes difficult on account of heat deformation but also the filament deforms by plastic deformation to decrease the cushioning property and mechanical strength thereof.

OBJECTS OF THE INVENTION

An object of the present invention, accordingly, is to provide a method and an apparatus for manufacturing three-dimensioned crimp, which is capable of giving fiber filaments crimps having three-dimentioned directivity, that is, three-dimensioned crimp, greatly contributing to the increase of resiliency and improvement of cushioning property when the filaments are made as lock material or contained within a cushioning material.

Another object of the present invention is to provide a method and an apparatus for three-dimensioned crimp filament, which can eliminate spreading the double twist formed in the double twist step back into the single twist step or zone.

BRIEF DESCRIPTION OF THE INVENTION

These objects are attained by a method for manufacturing a three-dimentioned crimp filament comprising: a single twist step for forming a plurality of large denier filaments with a single twist which are stretched between a freely rotatable first roller with a groove having 10–500 mm of diameter at a grooved bottom portion and at least one another freely rotatably second roller in 50,000–3,000,000 of total denier by twisting action in a subsequent double twist step; a double twist step for forming said filaments having passed through said single twist step with a double twist from an initial point and passing the double twisted filaments thus formed through a cylindrical guide means under heating; a cooling step for cooling said double twisted filaments thus formed while giving the twisting action sufficient time to effect a thermal set; a untwisting step for untwisting said double twisted filaments to form the three-dimentioned crimp filaments; and a cutting step for cutting said untwisted three-dimensioned crimp filaments.

This method may be carried out by an apparatus comprising; a cutting means for cutting untwisted filaments; a drive means for pulling filaments; a group of guide rollers arranged in a reverse U-shaped roller group, said roller group being located ahead of said drive means and being adapted to be rotated as a unit about a common axis in order to give forward and rearward portions of a plurality of filaments stretched along a pathway and transferred by said drive means, initially with a single twist formed thereon, mutually opposite twisting actions; a pair of rotative, grooved, non-slip rollers located immediately after the roller at the forward end in said reverse U-shaped roller group and adapted to rotate individually about longitudinal axes parallel with said common axis with one axis diametrically opposed to the other and as a unit with said reverse U-shaped roller group, said pair of rollers functioning to pull and simultaneously twist said filaments initially formed with a single twist at a rate which causes the filaments to form into a double twist; a guide means provided ahead of said roller group for the filaments formed with a double twist; a heating means serving to heat said filaments to a temperature such that on cooling the crimp of the filaments is given a permanent set; and a single twist means for forming a plurality of large denier filaments with a single twist by twisting action in said double twist step provided ahead of said guide means and comprising a freely rotatable first roller with a groove having 10–500 mm of diameter at the grooved portion and at least one another freely rotatable second roller.

The filaments used in accordance with the invention may be such synthetic fiber as polyester, polyamide, polyacrylonitrile, polypropylene, polyvinylidene chloride, vinylon and so forth and natural fiber, but synthetic fibers, amongst them polyester fiber, are preferred. The polyester fiber filaments are superior in rigidity to other synthetic fibers and also have high repulsive elasticity, so that when used for cushion in the form of a locked material very satisfactory cushioning property can be obtained. Thus, the filaments used according to the invention are preferably of 50–3,000 denier, more preferably of 100–1,000 denier, the most preferably of 150–600 denier, and the total dinier is 50,000–3,000,000 dinier, preferably 100,000–2,000,000 denier, the most preferably 150,000–1,000,000 denier.

The three-dimensioned crimp filament obtained according to the invention may be subjected to improvement of the cushioning property and rigidity after refinement by solely filling it into a cushion or formed into a locked material by locking the intersections of the filaments with an adhesive into a predetermined form. This locked material may be used solely as the cushion or incorporated in another cushion for improving the cushioning property and rigidity.

The term "two-dimensioned crimp" throughout the specification refers to what is regularly crimped in the form of a wave, and the term "three-dimensioned crimp" refers to what is obtained by providing an additional crimp to this wave state.

BRIEF DESCRIPTION OF THE DRAWINGS

The present invention will be understood best in conjunction with the accompanying drawings, in which.

DETAILED DESCRIPTION OF THE INVENTION

Figures 1, 6:
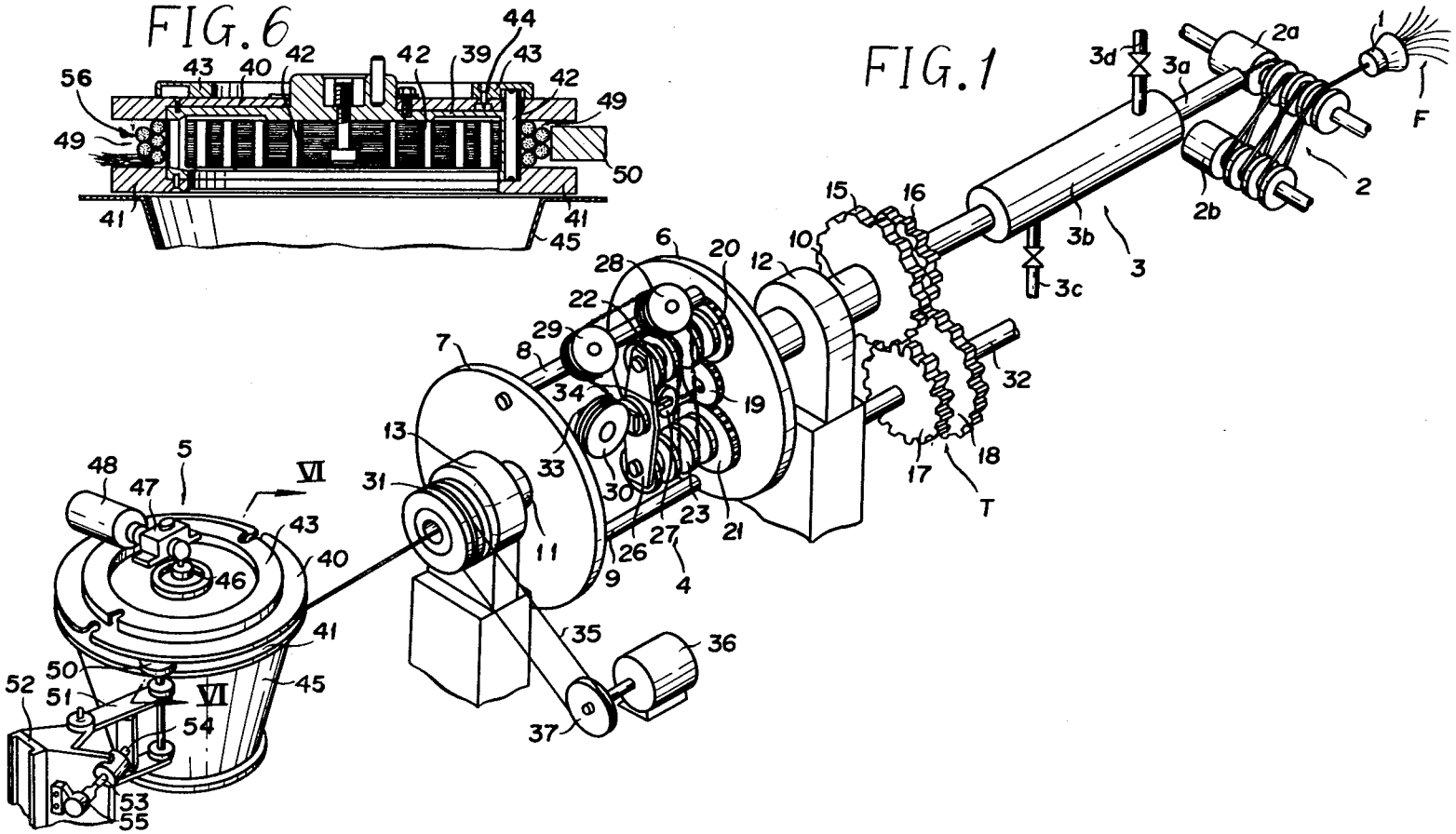
FIG. 1 is a perspective view of the apparatus in accordance with the present invention.
FIG. 6 is an enlarged sectional view of FIG. 1 along with a line VI—VI.

As shown in FIGS. 1 to 5, a filament supply inlet 1, a single twist transfer roller group 2, a guide means with a heating means 3, a twisting means 4 and tension drive means 5 are disposed in the mentioned order in the direction of feed of a filament. These individual parts will now be described in detail.

Figure 3:
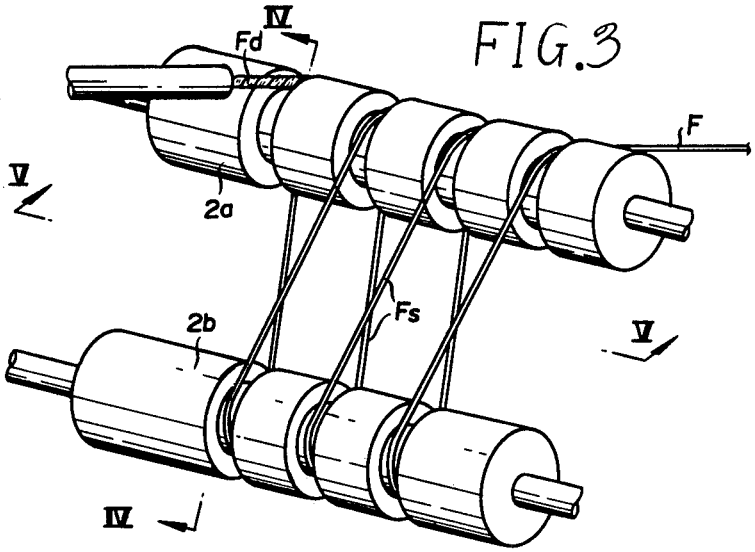
FIG. 3 is an enlarged perspective view of the single twist means.
Figure 5:
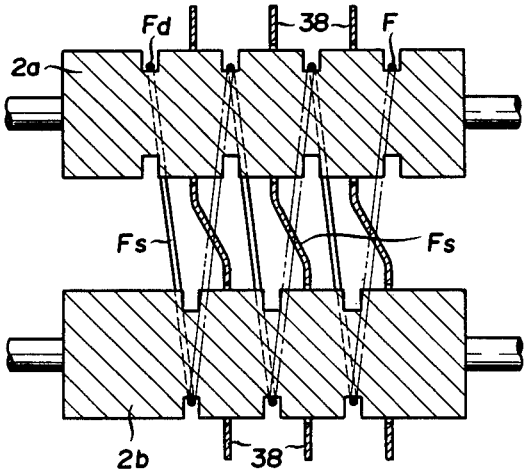
FIG. 5 is a sectional view of FIG. 3 along with a line V—V.

A plurality of filaments F approximately uniformly bundled at a filament supply inlet 1 are stretched to rollers 2 in a single twist step. The rollers 2 comprise a freely rotatable first roller 2*a* with a peripheral groove and at least one other freely rotatable second roller 2*b*. Although it is desirable that the second roller 2*b* also have a peripheral groove, it is not always necessary. If necessary, one or more rollers in addition to the second roller 2*b* may be provided, but these rollers may be provided coaxially with the first and second rollers 2*a* and 2*b* respectively by providing peripheral grooves and it is generally desirable to provide 3–4 or more of the grooves on each rollers. It is necessary that the each roller provided coaxially have the same diameter. Thus the filaments F are set so that the portion of the double twist formed in a subsequent double twist step as shown in FIGS. 1, 3 and 5 is stretched to the first roller 2*a* having the groove and the single twist portion Fs is stretched to the second roller 2*b* and further the subsequent filament F is stretched respectively to the rollers provided coaxially on the rollers 2*a* and 2*b* in order and finally it connected to the filament supply inlet 1.

Figure 4:
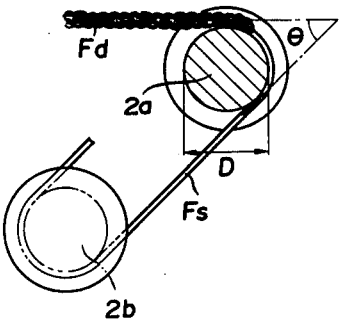
FIG. 4 is a sectional view of FIG. 3 along with a line IV—IV.

In such case, diameter D of the first roller 2*a* at the grooved portion should be 10–500 mm, preferably 20–300 mm, most preferably 30–150, although it depends upon a total denier of the filaments to be used, an angle $\theta$ between the double twist portion Fd and the single twist portion Fs and the like. Further, the angle $\theta$ between the double twist portion Fd and the single twist portion Fs as shown in FIG. 4 is preferably about 20° to about 70°. If feed rate of the filament is increased, productivity increases, but it is required to enlarge both heating means and cooling means. Further, width of the left hand groove on the first roller 2*a* is preferably somewhat larger than the diameter of the double twist Fd but not so much as to permit the formation of a triple twist or more by further twisting in it. Instead of the groove, two plates may be mounted to the roller without any grooves vertically to an axis thereof at a distance like the above mentioned width. Further, when the plurality of rollers are arranged coaxially to the first and second rollers 2*a* and 2*b* respectively, it is desirable that the grooves on one roller be positioned between the grooves on another roller a shown in FIG. 5. A guide 38 may be provided between the grooves, as shown in FIG. 5.

Figures 2, 7:
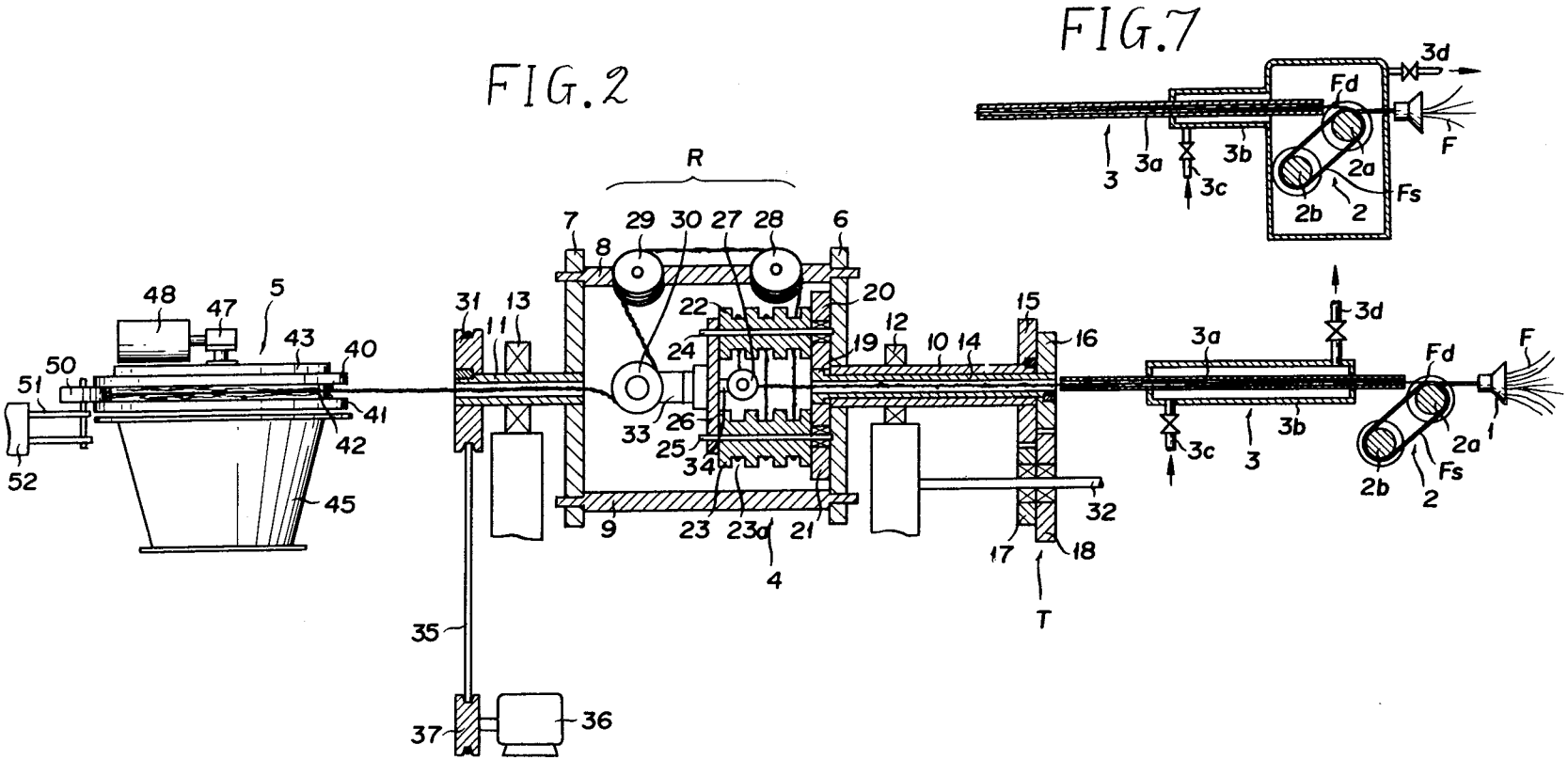
FIG. 2 is a sectional view of the apparatus in accordance with the present invention.
FIG. 7 is a sectional view of a heating means in another embodiment.

A guide means 3 providing a heating means includes a pipe 3*a* through which the double-twisted filaments Fd are passed, a jacket 3*b* on the outer side of the pipe 3*a*, a duct 3*c* for introducing high pressure steam into the jacket 3*b* and an exhaust duct 3*d*. It is desired that an inner diameter of the pipe 3*a* is slightly greater than that of double-twisted filament so as to prevent it being twisted further. Further, it is preferable that a distance between the guide means (pipe 3*a*) and the first roller 2*a* is as little as possible. Similarly, a distance between the below mentioned twisting apparatus 4 and the guide means 3 is preferably as little as possible. And as the heating means 3, may be used electric heating, infrared rays, high frequency heating and so forth. Further, in order to increase the efficiency, the heating means may be constructed so as to heat also the whole single twist step including rollers 2*a* and 2*b* except part of the guide means, as shown in FIG. 7. In such case, the heated portion of the guide means 3 may be small and may sometimes be omitted.

The twisting means 4 has two rotative discs 6 and 7 coupled together with two arms 8 and 9. The rotative discs 6 and 7 are provided at their center with respective hollow shafts 10 and 11. The shafts 10 and 11 are supported by respective bearings 12 and 13. A hollow shaft 14 for introducing the filaments is rotatably fitted in the interior of the shaft 10 on the side of filament introduction. Diameter of the hollow shaft is preferably somewhat greater than that of the double twist. The shaft 10 and hollow shaft 14 are provided at their ends with respective spur gears 15 and 16. These spur gears 15 and 16 are in mesh with respective spur gears 17 and 18 coaxially secured to a shaft 32 extending below them. These gears constitute a gear train. The hollow shaft 14 is provided at its other end on the side of the disc 6 with a sun gear 19 in mesh with planet gears 20 and 21 revolving therearound. Pair rollers 22 and 23 provided with rotary grooves are coupled via respective fixed shafts 24 and 25 to the planet gears 20 and 21. The rollers 22 and 23 are provided with respective grooves 22*a* and 23*a* such as to maintain proper transfer speed for forming the filament with double twist and sufficient cooling period to effect thermal set. The grooves 22*a* and 23*a* have wavy sectional profile such as to permit the filament formed with double twist to be pulled without causing slip. Further, number of the grooves is decided in order to maintain a proper distance for cooling and a necessary length, and the ends of the fixed shafts 24 and 25 are coupled together by means of a bracket 26. Guide rollers 27 and 30 are provided via brackets 33 and 34 to the opposite sides of the center portion of the bracket 26. The arm 8 is provided with guide rollers 28 and 29 constituting with guide rollers 27 and 30 a guide roller group R arranged in a reverse U-shaped roller group in order give a twisting action on the feed-in side and an untwisting action on the feed-out side. The shaft 11 is provided at the end thereof with a drive pulley 31 secured thereto and coupled via a belt 35 to a pulley 35 connected to a power source 36. Instead of the pulleys 31 and 37 and the belt 35, sprockets and chain may be used.

As the drive means for pulling filaments, it is preferable to provide a rotary cutter driven by a torque motor, as shown in FIGS. 1, 2 and 6. The rotary cutter 5 comprises a rotative disc 40 and rotative ring 41 connected by a spider 39 and forming a drum-like annular channel 49. In the grooves 39 there are provided many grooves in which are inserted knives 42 provided with a cutter edge facing radially in a vertical direction across the channel 49, and are fixed by a knife retainer 43 which is fixed to the disc 40 by bolts 44. A hopper 45 far receiving cut staples is provided under the rotative ring 41. A shaft of the rotary cutter is connected to a transmission by a coupling 46 and further connected to a torque motor 48. The bundle of filaments are wound on the knife edges in layers, as shown at 56, to provide anchorage for placing the filament bundle under tension and drawing it along the longitudinal pathway, and the end is continuously cut off in staple lengths by the following mechanism. Thus, a push roller 50 is inserted into the annular channel 49 formed between the rotative disc 40 and rotative ring 41 in a position to ride up on the outermost layer. The push roller 50 is mounted on a frame 52 by a swing arm 51 and is adjusted by movement of the swing arm to provide a gap between an edge of the knife 42 and the roller sufficiently narrow to cause the knives 42 to cut through the innermost layer of bundles 56, but not to cut through the outermost layer. The swing arm 51 is moved by a handle 53 connected to a socket 55 and to screw 54, rotation of which presses the roller 50 onto the outermost layer which, in turn, presses the innermost layer into the cutting edge of a screw knife 42, so that the innermost layer is continuously and successively cut into staple lengths when the roller 50 passes over a knife 42. Thereby the rotary cutter not only functions as a drive for pulling the untwisted filaments, but also as a cutter for cutting them into staple lengths.

The method of manufacture of the above apparatus by using a three-dimensioned crimp filament block will now be described.

A plurality of filaments, for instance, synthetic fiber filaments, pulled out from a plurality of bobbins (not shown) are passed through the filament supply inlet 1, passed round the rollers 2*a* and 2*b* in the single twist transfer roller group 2 as shown in FIGS. 1, 3 and 5, passed through the pipe 3*a* of the guide means and through the hollow shaft 14, and passed round the guide roller 27 and round the rollers 22 and 23 with the respectively rotary grooves in the mentioned order, and then they passed round the guide rollers 28, 29 and 30, passed through the shaft 11 and passed between the drive means for pulling 5.

Then, a motor 36 is driven to cause rotation of a pulley 31 in the clockwise direction so as to rotate the rotative discs 6 and 7 in the clockwise direction. As a result, the shaft 10 secured to the rotative disc 6 and the gear 15 coaxially secured to the shaft are rotated in the clockwise direction. Since the gear 17 in mesh with the gear 15 is rotated in the counterclockwise directon, thus causing rotation of the gear 18 in the same direction as the gear 17, the gear 16 and shaft 14 secured to the shaft are rotated in the clockwise direction. Further, a sun gear 19 secured to the hollow shaft 14 is rotated in the clockwise direction similar to the rotative disc, but a different rotational speed. With the rotation of the sun gear 19 the planet gears 20 and 21 are rotated in the opposite direction. Consequently, an action of mutual twisting of a plurality of filaments F in the opposite direction is produced before and after the guide roller group R. That is to say, when the filaments are pulled through a reverse U-shaped pathway formed by rollers 23, 28, 29 and 30 under giving twist action, the twist action acts to the dilaments at a first corner (roller 27) and spreads the double twist to the roller 2*a*, a fourth corner (roller 30) becomes a fulcrum for reverting the twist and produces effects for twisting and untwisting. Driving force for feeding the filaments to a progressive direction send the twisted filaments by changing rotation number of the gear 16 by means of combination of gears 17 and 18 as the same rotation as the rotative discs 6 and 7 and the gear 15. Therefore, occurence of uniform double twist based on total denier of the filaments, twisting and feeding is controlled by a ratio between the feeding and the twisting.

Figure 8:
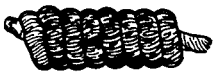
FIG. 8 is a perspective view of the double twisted filaments.

On one hand, the double twist as shown in FIG. 8 can be given to the filaments by twisting action given by means of the roller group R, but although the double twist Fd thus formed spreads to the first roller 2*a*, it does not spreads to the filaments stretched between the rollers 2a and 2b and gives a partial twisting action to the filaments to form a single twist Fs. The roller 2a has such an effect in preventing the spread of the double twist, only when diameter of the roller 2a is within the above mentioned range. That is to say, when the diameter is less than 10 mm, it is too small relative to the size of the double twist formed from 50,000–3,000,000 of total denier while when the diameter is more than 500 mm, it is thought that the influence of corresponding tension becomes small and the pressing force loaded to the roller 2a is dispersed. Further, the reason why the filaments are stretched to the rollers 2a and 2b 2–4 times is to prevent, by friction between the rollers and the filaments, the spreading of the double twist from the roller 2a due to the twisting stress which results from the length of the filaments becoming one-fourth that of the original length when the double twist is formed.

The filaments F provided with double twist are guided by the guide means 3 under heating not so as to set the twist and cooled down at roller group R to complete heat set.

Figure 9:
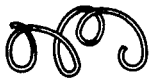
FIG. 9 is a perspective view of the three-dimentioned curl filament in accordance with the present invention.

Then, on the rear side of the roller 30 the filaments receive twisting action in the reverse direction, at the rotary cutters driven by a torque motor 48, especially at the position pushed by a swing roller 50 as a fulcrum, so the filaments are transferred under untwisting the double twist and are cut to a desired length, e.g., 30–300 mm, especially 50–150 mm by the knife 42 pushed by the swing roller 50 to obtain a staple fiber of a three-dimensioned crimp filaments as shown in FIG. 9. The above-mentioned torque motor 48 is connected to an electric source by way of a transformer (not shown).

The rotary cutter used in the present invention is used as a fulcrum for untwisting the double twist, so it can give a necessary tension to the filaments and act as the cutting means at the same time. On the contrary, in the above mentioned apparatus, not only is the velocity of the double twisted filament variable, depending upon the extent of the twist, but also the untwisted filaments have crimp and are subject to stretching. Accordingly, it is difficult to cut to a constant size unless the untwisted filaments are stretched continuously by a proper tension. Thus the above-mentioned rotary cutter is driven by a torque motor, so the filaments are stretched continuously by a proper tension and it becomes possible to cut them at a constant size. Therefore, untwisting or relaxation of the filaments between both fulcrums, which is apt to occur when the conventional motor is used, and disappearance of the crimp based on too strong tension and overload of the motor can be eliminated.

EXAMPLE 1

An apparatus shown in FIGS. 1–2 was operated by using a freely rotatable rollers 2a and 2b having peripheral grooves and having 80 mm of diameter the grooved portions arranged so that the angle $\theta$ between the double twist portion and single twist portion is 45° as shown in FIG. 3 and stretching 300 denier of polyester filament as a monofilament in 500,000 of total denier under 3.4 m/min of passing rate and 13 r.p.m. of rotation number of the roller 2a and the filaments were heat set at a temperature of 120°–130° C. In this operation, spreading the double twist passed over the roller 2a was not observed at all. When untwisted filament were cut by a rotary cutter 5 driven by a 30 kg/cm$^2$ of a torque motor at a length of 80 mm, the lengths were constant.

EXAMPLE 2

A similar manner as Example 1 was carried out except that the diameter of the roller 2a was 40 mm, the total denier was 250,000 denier, rotation number of the roller 2a was 16 r.p.m. and the passing rate was 2.25 m/min. As the result of the operation, spreading the double twist passed over the roller 2a was not able to be recognized at all. When untwisted filament were cut by a rotary cutter 5 driven by a 30 kg/cm$^2$ of a torque motor at a length of 70 mm, the lengths were constant.

What is claimed is:

1. A method for manufacturing a three-dimensioned crimp filament comprising:

twisting a bundle of large denier filaments into a single twist while said filaments are stretched between a freely-rotatable first roller with a peripheral groove having 10–500 mm of diameter at a grooved portion and at least one other freely-rotatable second roller in a total denier of 50,000–3,000,000 denier by means of twisting action in a subsequent double twist step;

double twisting said single-twisted filaments into a double twist up to said first roller and heating the filaments thus twisted into a double twist while passing them through a tubular guide means;

cooling said double-twisted filaments to effect a heat-set while maintaining the twisting action;

untwisting said double-twisted filaments thus heat-set to form three-dimensioned crimp filaments; and cutting said untwisted three-dimensioned crimp filaments into staple lengths, the diameter of said first roller at the grooved portion being correlated with the diameter of the double-twisted filaments formed from the 30,000–3,000,000 denier bundle to prevent the spread of the double twist back beyond said first roller under the tension necessary to form and maintain said double twist, and the width of said peripheral groove and the diameter of said tubular guide means being sufficient to freely receive the double-twisted filament, but insufficient to allow it to curl into a greater multiple twist.

2. A method according to claim 1, wherein said first and second rollers are arranged so that an angle between the double twist portion and the single twist portion is between about 20° to about 70°.

3. A method according to claim 2, wherein said cutting step is carried out by a rotary cutter driven by a torque motor, whereby staple filaments of uniform length are obtained.

4. An apparatus for manufacturing a three-dimensioned crimp filament comprising:

a single-twist roller group comprising a freely-rotatable, first transverse roller group with a peripheral groove having 10–500 mm of diameter at the groove portion and at least one other rotatable second transverse roller;

drive means for pulling a bundle of filaments around said transverse rollers and up over and in said peripheral groove in a longitudinal pathway leading from such peripheral groove to said drive means;

twisting means located ahead of said drive means adapted to give the portions of said bundle of filaments forward and rearward of said twisting means, while stretched along said longitudinal pathway and around said transverse rollers and pulled along by said drive means, mutually opposite twisting actions, whereby the portion of the forward portion ahead of said peripheral groove is given a single twist, the portion thereof between said peripheral groove and said twisting means, a double twist, and the rearward portion from said twisting means to said drive means is untwisted;

tubular guide means provided ahead of said twisting means for the filaments formed with a double twist;

heating means serving to heat the said double-twisted filaments to a temperature such that, on cooling, the crimp in said filaments is given a permanent heat-set, whereby untwisting results in a desired three-dimensional crimp filament; and, cutting means for cutting the three-dimensioned crimp filament bundle into staple lengths while under tension, the diameter of said first roller at the grooved portion being correlated with the diameter of the double-twisted filaments formed from the 30,000–3,000,000 denier bundle to prevent the spread of the double twist back beyond said first roller under the tension necessary to form and maintain said double twist, and the width of said peripheral groove and the diameter of said tubular guide means being sufficient to freely receive the double-twisted filament, but insufficient to allow it to curl into a greater multiple twist.

5. An apparatus according to claim 4, wherein said first and second rollers are arranged so that an angle between the double twist portion and the single twist portion is between about 20° to about 70°.

6. An apparatus according to claim 5, wherein said cutting means for the untwisted filaments and said drive means for pulling the fillaments comprises a rotary cutter driven by a torque motor.

7. An apparatus according claim 5, wherein the single twist means comprises two freely rotatable rollers respectively having plurality of grooves and having same diameter.

8. A method according to claim 1, in which the cutting step and the pulling step are effected simultaneously by winding the untwisted, heat-set, double-twisted filament bundle in multiple layers on a drum and cutting the lowermost layer into staple lengths while leaving the outermost layer intact.

9. Apparatus according to claim 4, in which said cutting means and said drive means comprise means for winding the untwisted, heat-set, double-twisted filament bundle in multiple layers on a drum and means for cutting the lowermost layer into staple lengths while leaving the outermost layer intact.

10. An apparatus for manufacturing a three-dimensional crimp filament which comprises, supply means for continuously supplying a bundle of filaments to a filament pathway comprising a twisting means for imparting a single twist and a double twist to the filament bundle in said filament pathway, a single-twist roller group interposed between the double twist and the single twist for preventing the double twist from going back in the filament train beyond said roller group, heating and cooling means for imparting a heat-set to said twisted filament bundle, untwisting means for untwisting the heat-set, double-twisted filament bundle, and tension drive means for drawing said filament bundle along said filament pathway, the improvement which comprises; an annular channel which is open at its outer periphery, is mounted for rotation about a vertical axis, and has an inner drum means about which the untwisted, heat-set, double-twisted filament bundle can be wound in a plurality of layers; torque inducing means for applying a torque to said annular channel in order to place the desired tension on the continuous filament bundle in said filament pathway; said drum means comprising spaced knife edges which are in cutting contact with the innermost layer of the filament bundle wound on said drum means; roller means in said annular channel adapted to ride on the outermost layer of said filament bundle wound on said drum; and, pressure means for causing said roller means to press against the outermost layer of the filament bundle wound on said drum and to force the innermost layer thereof into cutting contact with said knife edge; and said pressure means being adjustable, so that the pressure can be increased or decreased as required to effect cutting of the filament bundle in the lowermost layer without cutting it in the outermost layer, whereby continued tension is maintained on the filament bundle in the filament pathway while continuously cutting the untwisted, heat-set, double-twisted filament bundle into staple lengths.

11. In a process for manufacturing a three-dimensional crimp filament which comprises continuously supplying a bundle of filaments to a filament pathaway in which the filament bundle is twisted into a single twist and the single twist into a double twist, the double-twisted filament bundle is heated and cooled to impart a heat-set thereto and then untwisted, the improvement which comprises continuously winding the untwisted, heat-set, double-twisted filament bundle on a drum into a winding thereon having a plurality of layers to provide a tension necessary to draw said filament bundle along said pathway and cutting the innermost layer of said winding at spaced intervals corresponding to the staple length desired without cutting the outermost layer of said winding, whereby continued tension is maintained on the filament bundle in the filament pathway while continuously cutting the untwisted, heat-set, double-twisted bundle into staple lengths.

12. Apparatus according to claim 10, in which said single-twist roller group comprises a freely-rotatable first roller with a peripheral groove having 10–500 mm diameter at the grooved portion and at least one other freely-rotatable second roller mounted to rotate on an axis parallel to the axis of the first roller, which is displaced forward of the axis of the first roller sufficiently that the angle between the double-twisted portion and the single-twisted portion of the filament bundle is between about 20° and about 70°.

* * * * *

UNITED STATES PATENT AND TRADEMARK OFFICE

CERTIFICATE OF CORRECTION

PATENT NO. : 4,244,175

DATED : January 13, 1981

INVENTOR(S) : Sadaaki Takagi

It is certified that error appears in the above—identified patent and that said Letters Patent is hereby corrected as shown below:

On The Title Page,
[57] ABSTRACT, line 17; "stable" should read -- staple --

Col. 1, line 37; delete "single"
Col. 1, line 38; insert -- single -- before "twist"
Col. 5, line 54; "grooves 39" should read -- spider 39, --

Col. 5, line 58; "far" should read -- for --

Col. 6, line 11 & 12; delete "a screw"

Col. 6, line 39; "directon" should read -- direction --
Col. 7, line 48; "or" should read -- on --

UNITED STATES PATENT AND TRADEMARK OFFICE

CERTIFICATE OF CORRECTION

PATENT NO. : 4,244,175

DATED : January 13, 1981

INVENTOR(S) : Sadaaki Takagi

It is certified that error appears in the above—identified patent and that said Letters Patent is hereby corrected as shown below:

Col. 2, line 45; "a" (second occurrence) should read -- an --
Col. 3, line 26; "dinier" should read -- denier --
Col. 3, line 27; "dinier" should read -- denier --
Col. 4, line 22; delete "the" (second occurrence)
Col. 4, line 53; "a" (first occurrence) should read -- as --
Col. 6, line 53; "dilaments" should read -- filaments --
Col. 6, line 61; "occurence" should read -- occurrence --
Col. 7, line 1; "spreads" should read -- spread --
Col. 9, line 32; "fillaments" should read -- filaments --
Col. 9, line 34; insert -- to -- before "claim"
Col. 10, line 32; "pathaway" should read -- pathway --

Signed and Sealed this

*Sixth* Day of *July 1982*

[SEAL]

*Attest:*

GERALD J. MOSSINGHOFF

*Attesting Officer*

*Commissioner of Patents and Trademarks*